US009140473B2

(12) United States Patent
Kim

(10) Patent No.: US 9,140,473 B2
(45) Date of Patent: Sep. 22, 2015

(54) CONDENSER FOR VEHICLE

(75) Inventor: Jae Yeon Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 365 days.

(21) Appl. No.: 13/532,503

(22) Filed: Jun. 25, 2012

(65) Prior Publication Data

US 2013/0146265 A1 Jun. 13, 2013

(30) Foreign Application Priority Data

Dec. 8, 2011 (KR) ..... 10-2011-0131298

(51) Int. Cl.
*F25B 39/04* (2006.01)
*F28D 9/00* (2006.01)
*F28D 21/00* (2006.01)

(52) U.S. Cl.
CPC ..... *F25B 39/04* (2013.01); *F28D 9/005* (2013.01); *F28D 2021/0084* (2013.01)

(58) Field of Classification Search
CPC .. F25B 29/04; F25B 40/02; F25B 2321/0252; F25B 2339/047; F28D 9/005; F28D 9/0056
USPC ..... 62/304, 506, 474, 509; 165/166, 167, 165/119, 132
See application file for complete search history.

(56) References Cited

U.S. PATENT DOCUMENTS 5,520,015 A * 5/1996 Lukas et al. ..... 62/506
6,230,508 B1 * 5/2001 Baker et al. ..... 62/244
6,494,059 B2 * 12/2002 Yamazaki et al. ..... 62/509
6,889,521 B2 * 5/2005 Seno et al. ..... 62/506
7,231,778 B2 * 6/2007 Rigney et al. ..... 62/407
7,264,043 B2 * 9/2007 Alinovi et al. ..... 165/119
7,469,554 B2 * 12/2008 Martins et al. ..... 62/506
7,836,725 B2 * 11/2010 Lautner et al. ..... 62/506
2007/0125527 A1 * 6/2007 Flik et al. ..... 165/140
2009/0071189 A1 * 3/2009 Martins et al. ..... 62/506

(Continued)

FOREIGN PATENT DOCUMENTS

DE 102010026507 A1 * 1/2012
DE 102011007701 A1 * 10/2012

(Continued)

*Primary Examiner* — Allen Flanigan
*Assistant Examiner* — For K Ling
(74) *Attorney, Agent, or Firm* — Morgan, Lewis & Bockius LLP

(57) ABSTRACT

A condenser for a vehicle is used in an air conditioning having an expansion valve, an evaporator, and a compressor, is provided between the compressor and the expansion valve, and circulates coolant supplied from a radiator to condense refrigerant supplied from the compressor through heat-exchange with the coolant and the refrigerant.

The condenser may include a first heat-radiating portion connected to the radiator to circulate coolant and adapted to circulate refrigerant to condense the refrigerant through heat-exchange, a second heat-radiating portion formed at a lower portion of the first heat-radiating portion, a receiver-drier portion disposed apart from the first and second heat-radiating portions to perform gas-liquid separation and moisture removal of the condensed refrigerant, and a lower cover to connect the second heat-radiating portion with the receiver-drier portion, wherein the connecting passage is adapted to flow the refrigerant from the receiver-drier portion into the second heat-radiating portion.

12 Claims, 6 Drawing Sheets

(56) References Cited

U.S. PATENT DOCUMENTS

| | | | | |
|---|---|---|---|---|
| 2012/0273179 | A1* | 11/2012 | Tiziano et al. | 165/166 |
| 2013/0153072 | A1* | 6/2013 | Vreeland et al. | 138/30 |
| 2013/0283838 | A1* | 10/2013 | Kadle et al. | 62/238.6 |

FOREIGN PATENT DOCUMENTS

| | | | |
|---|---|---|---|
| EP | 2476975 | A2 * | 7/2012 |
| FR | 2923899 | A1 * | 5/2009 |
| FR | 2947041 | A1 * | 12/2010 |
| JP | 09053867 | A * | 2/1997 |
| JP | 2005-121319 | A | 5/2005 |
| JP | 2010-105656 | A | 5/2010 |
| KR | 10-2010-0092112 | A | 8/2010 |
| KR | 10-2011-0002139 | A | 1/2011 |
| KR | 1020110002139 | A | 1/2011 |
| KR | 10-1188226 | B | 9/2012 |
| KR | 10-1222590 | B | 1/2013 |

* cited by examiner

CONDENSER FOR VEHICLE

CROSS-REFERENCE TO RELATED APPLICATION

The present application claims priority of Korean Patent Application Number 10-2011-0131298 filed Dec. 8, 2011, the entire contents of which application is incorporated herein for all purposes by this reference.

BACKGROUND OF INVENTION

1. Field of Invention

The present invention relates to a condenser for a vehicle. More particularly, the present invention relates to a condenser for a vehicle that is stacked-plate type in which a receiver-drier portion is integrally formed and that is water-cooled type in which refrigerant is condensed by coolant.

2. Description of Related Art

Generally, an air conditioning for a vehicle maintains suitable cabin temperature regardless of ambient temperature and realizes comfortable indoor environment.

Such an air conditioning includes a compressor compressing a refrigerant, a condenser condensing and liquefying the refrigerant compressed by the compressor, an expansion valve quickly expanding the refrigerant condensed and liquefied by the condenser, and an evaporator evaporating the refrigerant expanded by the expansion valve and cooling air which is supplied to the cabin in which the air conditioning is installed by using evaporation latent heat.

Herein, the condenser cools compressed gas refrigerant of high temperature/pressure by using an outside air flowing into the vehicle when running and condenses it into liquid refrigerant of low temperature.

Such a condenser is generally connected through a pipe to a receiver-drier which is provided for improving condensing efficiency through gas-liquid separation and removing moisture in the refrigerant.

An air-cooled condenser which heat-exchanges with the outside air is mainly used for the condenser for the vehicle. Since such an air-cooled condenser has pin-tube structures, entire size of the condenser may be increased so as to improve cooling performance. Therefore, the air-cooled condenser may be hard to be installed in a small engine compartment.

In order to solve such a problem, a water-cooled condenser which uses coolant as refrigerant is applied to the vehicle.

However, the water-cooled condenser, compared with the air-cooled condenser, has lower condensing temperature of the refrigerant by about 5-15° C., and accordingly difference between the condensing temperature and the ambient temperature is small. Therefore, condensing efficiency may be deteriorated due to small sub-cool effect, and accordingly cooling efficiency may also be deteriorated.

In addition, size of a radiator or capacity of a cooling fan may be increased so as to increase condensing efficiency or cooling efficiency of the water-cooled condenser for the vehicle. Therefore, cost and weight may increase and connections between the receiver-drier and the condenser may be complex.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a condenser for a vehicle having advantages of reducing the number of components, simplifying a layout of connection pipes and lowering cost and weight as a consequence that the condenser is integrally formed with a receiver-drier portion, is formed by stacking a plurality of plate, and is adapted to cool refrigerant by using coolant.

Various aspects of the present invention provide for a condenser for a vehicle having advantages of improving cooling efficiency by reducing dead volume in the condenser and increasing heat-radiating area.

A condenser for a vehicle according to various aspects of the present invention is used in an air conditioning having an expansion valve, an evaporator, and a compressor, is provided between the compressor and the expansion valve, and circulates coolant supplied from a radiator so as to condense refrigerant supplied from the compressor through heat-exchange with the coolant and the refrigerant.

The condenser may include a first heat-radiating portion formed by stacking a plurality of plates, connected to the radiator so as to circulate the coolant, and adapted to circulate the refrigerant supplied from the compressor so as to condense the refrigerant through heat-exchange with the coolant and the refrigerant, a second heat-radiating portion integrally formed at a lower portion of the first heat-radiating portion, a receiver-drier portion formed by stacking a plurality of plates, disposed apart from the first and second heat-radiating portions, and connected respectively to the first and second heat-radiating portions so as to perform gas-liquid separation and moisture removal of the condensed refrigerant supplied from the first heat-radiating portion and to supply the refrigerant to the second heat-radiating portion, and a lower cover adapted to connect a lower portion of the second heat-radiating portion with a lower portion of the receiver-drier portion and having a connecting passage formed therein, the connecting passage being adapted to flow the refrigerant from the receiver-drier portion into the second heat-radiating portion.

The condenser may further include a connecting pipe adapted to connect the receiver-drier portion with the first heat-radiating portion.

The first heat-radiating portion may include a refrigerant inlet formed at an end portion of the first heat-radiating portion and connected to the compressor so as to flow the refrigerant into the first heat-radiating portion, and a first connecting hole formed at the other end portion of the first heat-radiating portion, an end of the connecting pipe being inserted in the first connecting hole.

The receiver-drier portion may be provided with a second connecting hole corresponding to the first connecting hole, and the other end of the connecting pipe may be inserted in the second connecting hole such that the refrigerant flows from the first heat-radiating portion into the second connecting hole through the connecting pipe.

The first heat-radiating portion may be adapted to condense the refrigerant by exchanging heat with the coolant and to exhaust the condensed refrigerant to the receiver-drier portion through the connecting pipe connected to the first connecting hole.

The lower cover may include a refrigerant outlet formed at an end portion of the lower cover corresponding to the coolant inlet and adapted to connect the second heat-radiating portion with the expansion valve, and a coolant inlet formed at an end portion of the lower cover apart from the coolant outlet and adapted to connect the first and second heat-radiating portions with the radiator.

The first heat-radiating portion may further include a coolant outlet formed at the other end thereof apart from the first connecting hole and connected to the radiator so as to exhaust the coolant to the radiator.

The second heat-radiating portion may be adapted to cause the refrigerant which is exhausted from the first heat-radiating portion and in which gas-liquid separation and moisture removal are performed at the receiver-drier portion to secondarily exchange heat with the low temperature coolant.

The receiver-drier portion may be provided with a space formed therein and a desiccant may be inserted in the space.

The connecting passage may be formed in the lower cover between the second heat-radiating portion and the receiver-drier portion, an end of the connecting passage may be connected to a third connecting hole formed at a lower portion of the other end portion of the second heat-radiating portion, and the other end of the connecting passage may be connected to the receiver-drier portion.

The condenser may further include a fixing plate corresponding to the connecting passage, the space, and the third connecting hole and mounted at the lower cover, wherein the fixing plate prevents leakage of the refrigerant to the exterior and prevents the desiccant inserted in the space from escaping.

The second heat-radiating portion may cause the coolant and the refrigerant to exchange heat with each other by means of counterflow of the coolant and the refrigerant.

The radiator may be connected to a reserve tank and a cooling fan may be provided at a rear portion of the radiator.

The condenser may include a heat exchanger of plate type formed by stacking a plurality of plates.

The lower cover may further include a fixing protrusion formed along a width direction between the first and second heat-radiating portions and the receiver-drier portion, and the fixing protrusion may be adapted to fix the first and second heat-radiating portions and the receiver-drier portion in a state that the first and second heat-radiating portions and the receiver-drier portion are disposed apart from each other.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
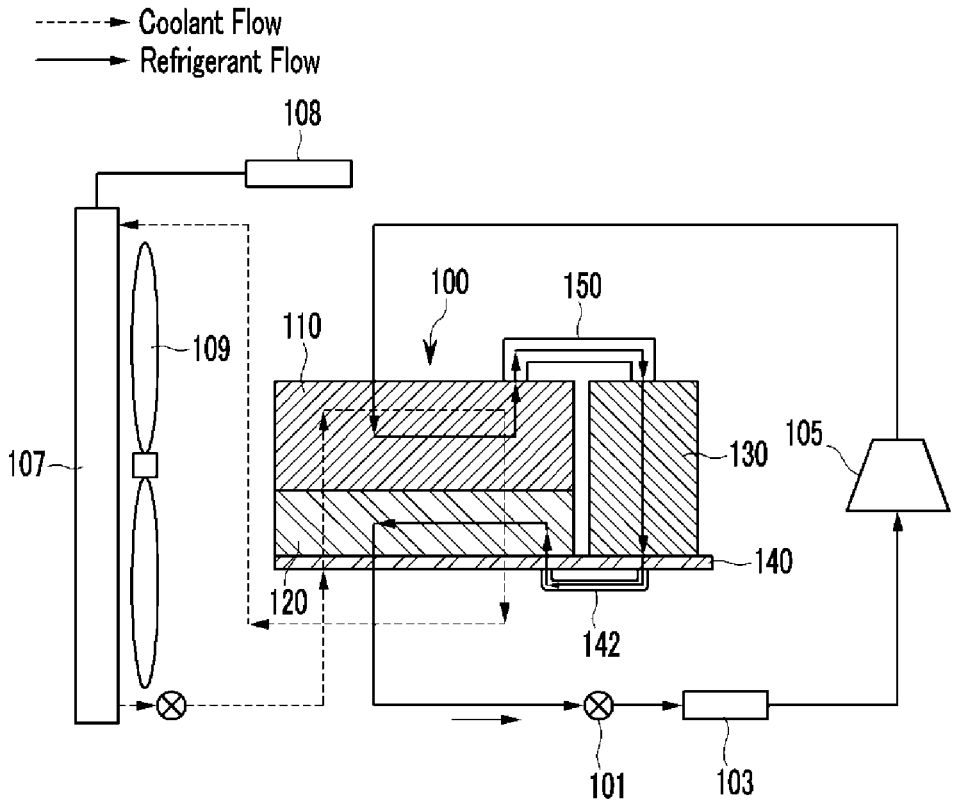
FIG. 1 is a schematic diagram of an exemplary air conditioning of a vehicle to which a condenser according to the present invention is applied.
Figure 2:
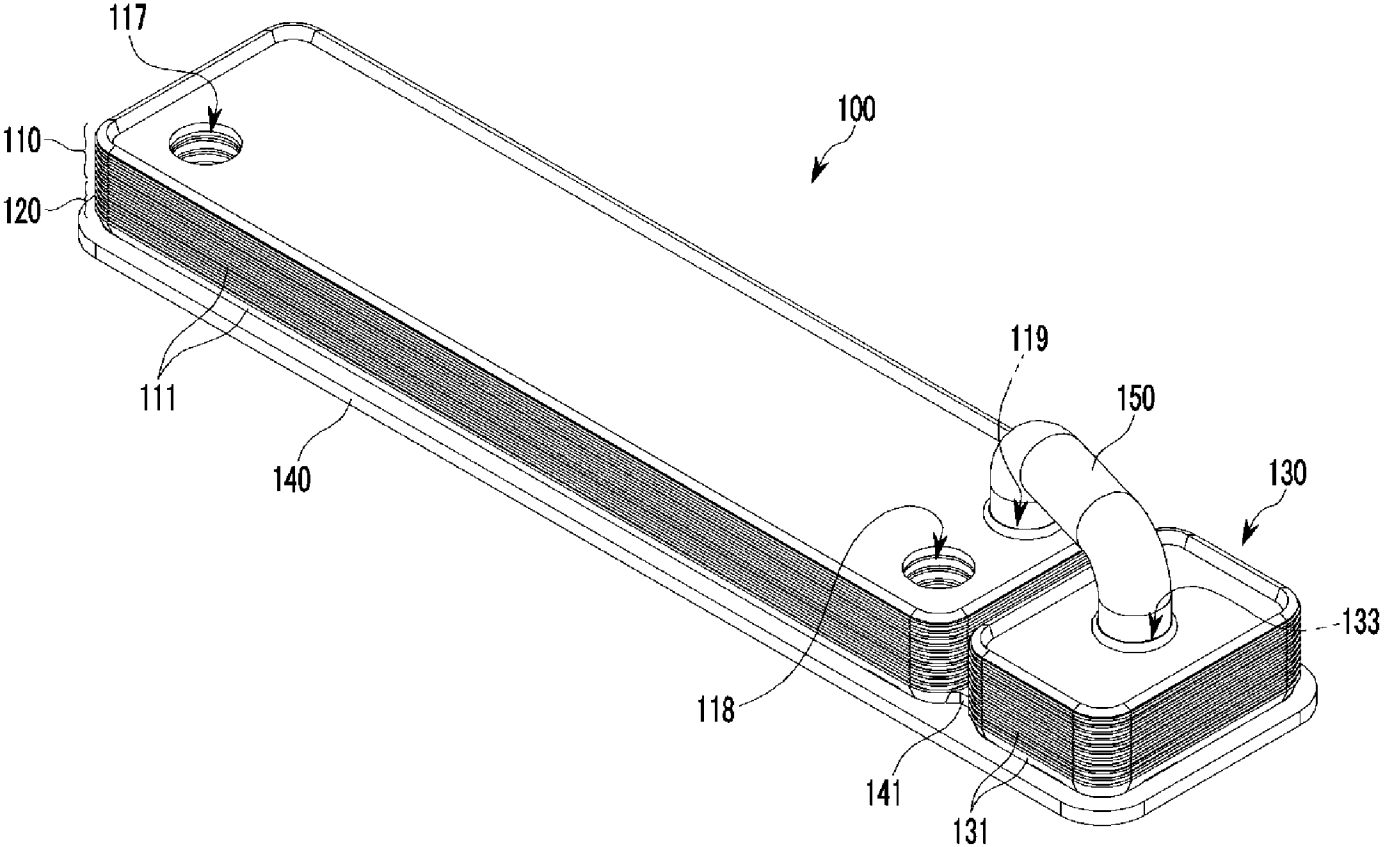
FIG. 2 is a perspective view of an exemplary condenser for a vehicle according to the present invention.
Figure 3:
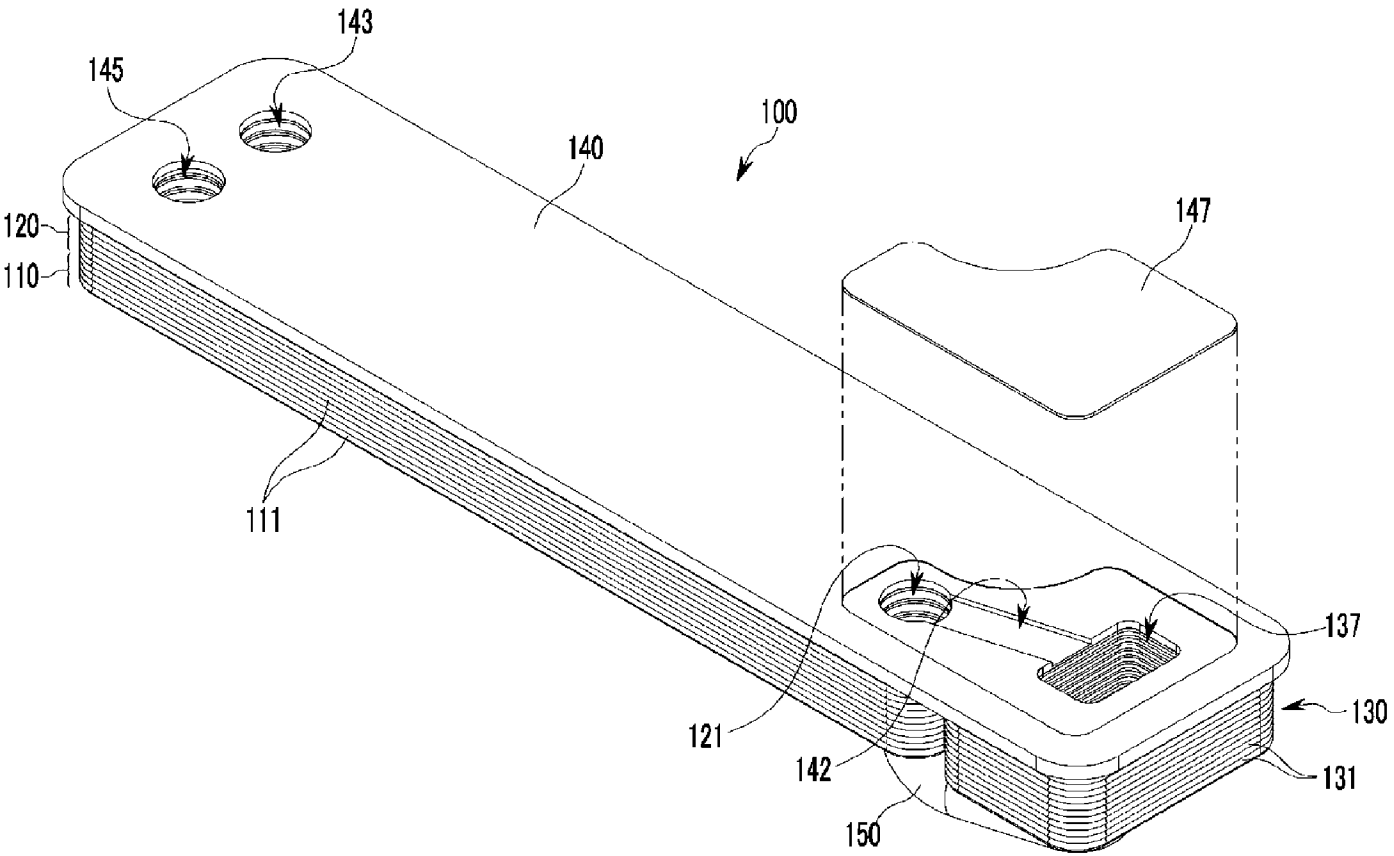
FIG. 3 is another perspective view of an exemplary condenser for a vehicle according to the present invention.
Figure 4:
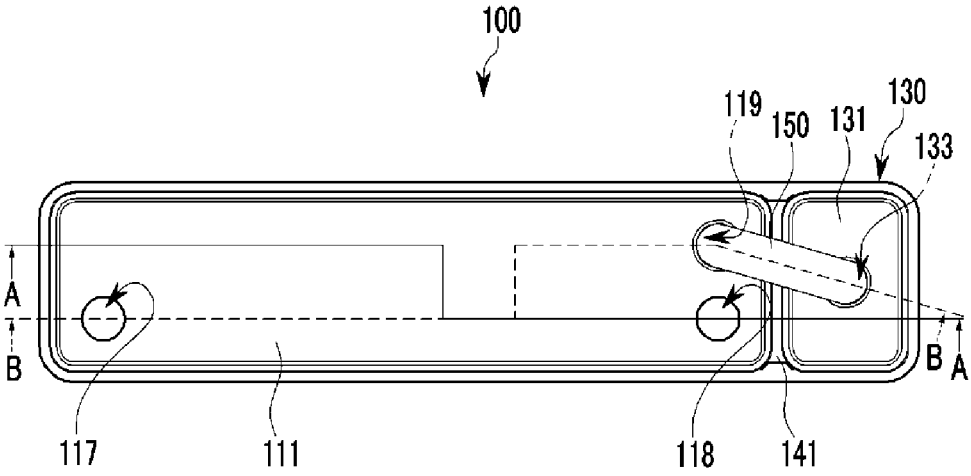
FIG. 4 is a top plan view of an exemplary condenser for a vehicle according to the present invention.
Figure 5:
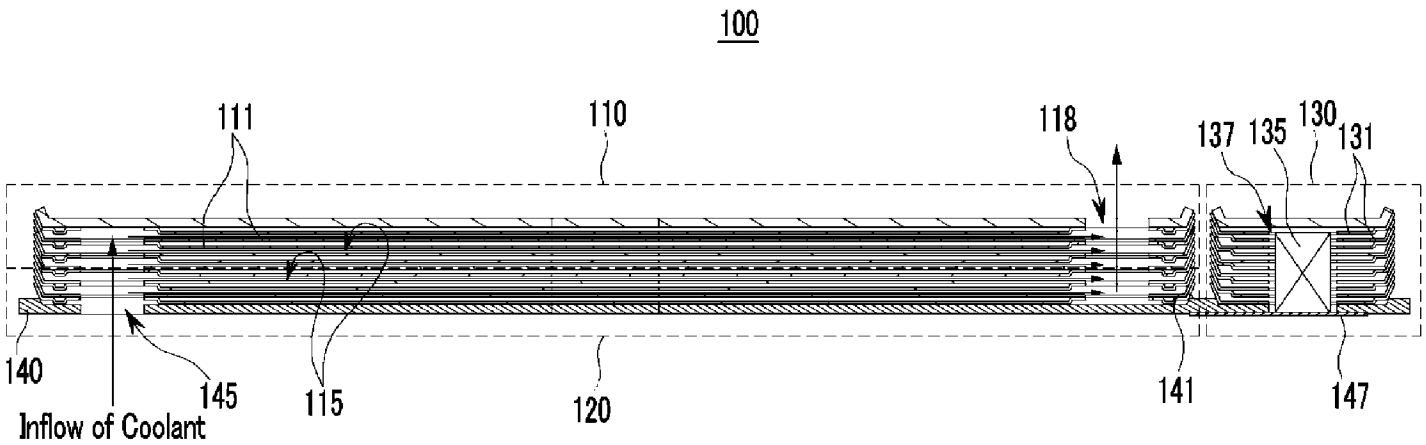
FIG. 5 is a cross-sectional view taken along the line A-A in FIG. 4.
Figure 6:
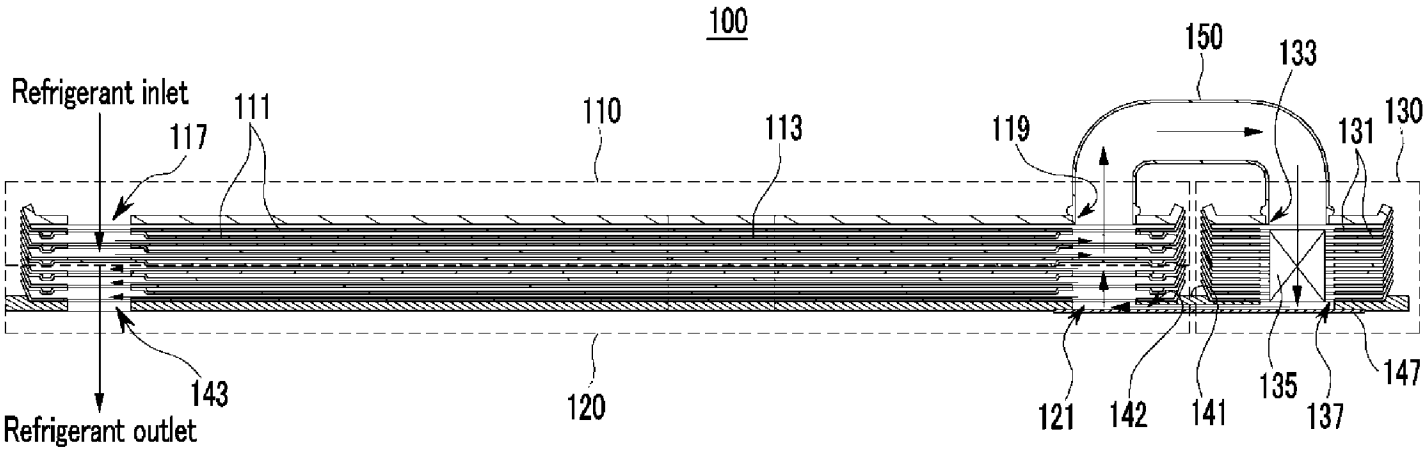
FIG. 6 is a cross-sectional view taken along the line B-B in FIG. 4.

FIG. 1 is a schematic diagram of an air conditioning of a vehicle to which a condenser according to various embodiments of the present invention is applied; FIG. 2 is a perspective view of a condenser for a vehicle according to various embodiments of the present invention; FIG. 3 is another perspective view of a condenser for a vehicle according to various embodiments of the present invention; FIG. 4 is a top plan view of a condenser for a vehicle according to various embodiments of the present invention; FIG. 5 is a cross-sectional view taken along the line A-A in FIG. 4; and FIG. 6 is a cross-sectional view taken along the line B-B in FIG. 4.

A condenser 100 for a vehicle according to various embodiments of the present invention, as shown in FIG. 1, is used in an air conditioning which includes an expansion valve 101 for expanding a liquid refrigerant, an evaporator 103 for evaporating the refrigerant expanded by the expansion valve 101 through heat-exchange with an air, and a compressor 105 for receiving from the evaporator 103 and compressing a gaseous refrigerant.

That is, the condenser 100 is provided between the compressor 105 and the expansion valve 101, and is configured to circulate a coolant supplied from a radiator 107 and to condense the refrigerant supplied from the compressor 105 through heat-exchange with the coolant.

The radiator 107 is connected to a reserve tank 108, and a cooling fan 109 is provided at a rear portion of the radiator 107.

Herein, a receiver-drier portion 130 is integrally provided and a plurality of plates 111 and 131 is stacked in the condenser 100 for the vehicle according to various embodiments of the present invention. The condenser 100 for the vehicle is adapted to condense the refrigerant by using the coolant. Therefore, the number of components may be reduced, a layout of connection pipes may be simplified, and cost and weight may be lowered. In addition, since dead volume in the condenser 100 for the vehicle can be minimized and heat-radiating area may be increased, cooling efficiency may be improved.

For these purposes, the condenser 100 for the vehicle according to various embodiments of the present invention, as shown in FIG. 2 to FIG. 4, includes a first heat-radiating portion 110, a second heat-radiating portion 120, the receiver-drier portion 130 and a lower cover 140.

The first heat-radiating portion 110 is formed by stacking a plurality of plates 111, is connected to the radiator 107 so as to circulate the coolant, and is adapted to circulate the refrigerant supplied from the compressor 105 so as to condense the refrigerant through heat-exchange with the coolant.

In addition, the second heat-radiating portion 120 is integrally formed at a lower portion of the first heat-radiating portion 110.

The second heat-radiating portion 120 is adapted to secondarily cool the refrigerant cooled and condensed at the first heat-radiating portion 110.

Herein, the second heat-radiating portion 120 is adapted to perform heat-exchange by means of counterflow of the coolant and the refrigerant.

That is, the plurality of plates 111 is stacked in the second heat-radiating portion 120, and refrigerant lines 113 and coolant lines 115 are alternately formed between the plurality of plates 111. Since the refrigerant passes through the refrigerant line 113 and the coolant passes through the coolant line 115, the refrigerant and the coolant are not mixed to each other. In addition, the refrigerant and the coolant flow to opposite directions and exchange heat with each other.

According to various embodiments, the receiver-drier portion 130 is formed by stacking a plurality of plates 131, and is disposed apart from the first and second heat-radiating portions 110 and 120.

In addition, the receiver-drier portion 130 is connected to the first heat-radiating portion 110 so as to receive the condensed refrigerant from the first heat-radiating portion 110 and to perform gas-liquid separation and moisture removal of the refrigerant. In addition, the receiver-drier portion 130 is connected to the second heat-radiating portion 120 so as to supply to the second heat-radiating portion 120 the refrigerant in which gas-liquid separation and moisture removal are performed.

Since the receiver-drier portion 130 uses a receiver-drier having the same shape as the condenser 100, dead volume thereof may be minimized, compared with a conventional receiver-drier of cylindrical shape.

Herein, the receiver-drier portion 130 is connected to the first heat-radiating portion 110 through a connecting pipe 150.

According to various embodiments, a refrigerant inlet 117 is formed at an end portion of the first heat-radiating portion 110 which is an opposite side of the receiver-drier portion 130. The refrigerant inlet 117 is connected to the compressor 105, and the refrigerant flows into the first heat-radiating portion 110 through the refrigerant inlet 117.

In addition, a first connecting hole 119 in which an end of the connecting pipe 150 is inserted is formed at the other end portion of the first heat-radiating portion 110.

The first heat-radiating portion 110 is adapted to condense the refrigerant flowing therein through heat-exchange with the coolant and to flow the condensed refrigerant to the receiver-drier portion 130 through the connecting pipe 150 connected to the first connecting hole 119.

Herein, a second connecting hole 133 corresponding to the first connecting hole 119 is formed at the receiver-drier portion 130. The other end of the connecting pipe 150 is inserted in the second connecting hole 133 such that the refrigerant flows from the first heat-radiating portion 110 to the receiver-drier portion 130 through the connecting pipe 150.

A space 137 is formed in the receiver-drier portion 130 and a desiccant 135 is inserted in the space 137.

According to various embodiments, the desiccant 135 is configured to remove moisture in the condensed refrigerant.

The desiccant 135 can be replaced according to replacement period. That is, the desiccant 135 is replaceably mounted in the receiver-drier portion 130.

According to various embodiments, the lower cover 140 connects a lower portion of the second heat-radiating portion 120 with a lower portion of the receiver-drier portion 130.

A fixing protrusion 141 is formed at the lower cover 140 between the first and second heat-radiating portions 110 and 120 and the receiver-drier portion 130 along a width direction of the lower cover 140. The fixing protrusion 141 fixes the first and second heat-radiating portions 110 and 120 to the lower cover 140 in a state that the first and second heat-radiating portions 110 and 120 are positioned apart from the receiver-drier portion 130.

A connecting passage 142 is formed in the lower cover 140 and the refrigerant flows from the receiver-drier portion 130 to the second heat-radiating portion 120 through the connecting passage 142.

That is, the second heat-radiating portion 120 receives the refrigerant in which gas-liquid separation and moisture removal are performed from the receiver-drier portion 130 through the connecting passage 142. In addition, the second heat-radiating portion 120 causes the refrigerant to secondarily exchange heat with the coolant.

Herein, a refrigerant outlet 143 connected to the second heat-radiating portion 120 is formed at an end portion of the lower cover 140 corresponding to the refrigerant inlet 117, and the second heat-radiating portion 120 is connected to the expansion valve 101 through the refrigerant outlet 143.

In addition, a coolant inlet 145 is formed at the end portion of the lower cover 140. The coolant inlet 145 is disposed apart from the refrigerant outlet 143, and is connected to the first and second heat-radiating portions 110 and 120. The first and second heat-radiating portions 110 and 120 are connected to the radiator 107 through the coolant inlet 145.

Herein, a coolant outlet 118 is formed at the other end portion of the first heat-radiating portion 110. The coolant outlet 118 is disposed apart from the first connecting hole 119, and is connected to the radiator 107 so as to exhaust the coolant to the radiator 107.

That is, the low temperature coolant supplied from the radiator 107 flows into the condenser 100 through the coolant inlet 145 formed at the lower cover 140. The low temperature coolant flowing into the condenser 100 passes the second heat-radiating portion 120 firstly.

In addition, the refrigerant passes the receiver-drier portion 130 after being cooled at the first heat-radiating portion 110. After that, the refrigerant flows into the second heat-radiating portion 120 through the connecting passage 142. Since the refrigerant is secondarily cooled by the low temperature coolant at the second heat-radiating portion 120, cooling efficiency may be improved.

According to various embodiments, a filter is integrally formed with the desiccant 135, and the filter removes foreign materials contained in the refrigerant supplied to the receiver-drier portion 130.

That is, the moisture remaining in the refrigerant is removed by the desiccant 135 and the foreign materials contained in the refrigerant are filtered by the filter. After that, the coolant is secondarily cooled at the second heat-radiating portion 120 and then flows to the expansion valve 101 through the refrigerant outlet 143.

Accordingly, it is prevented for the foreign materials remaining in the refrigerant from blocking the expansion valve 101.

According to various embodiments, the connecting passage 142 may be a groove formed at the lower cover 140 between the second heat-radiating portion 120 and the receiver-drier portion 130.

An end of the connecting passage 142 is connected to a third connecting hole 121 formed at a lower portion of the other end of the second heat-radiating portion 120, and the other end of the connecting passage 142 is connected to the space 137 of the receiver-drier portion 130.

That is, the refrigerant exhausted from the space 137 of the receiver-drier portion 130 flows into the third connecting hole 121 formed at the second heat-radiating portion 120 through the connecting passage 142. After that, the refrigerant passes through the second heat-radiating portion 120.

Herein, a fixing plate 147 corresponding to the connecting passage 142, the space 137 and the third connecting hole 121 is mounted at the lower cover 140. The fixing plate 147 is adapted to prevent leakage of the refrigerant to the exterior and to prevent the desiccant 135 inserted in the space 137 from escaping.

The condenser 100 according to various embodiments of the present invention includes a heat exchanger of plate type formed by stacking the plurality of plates 111 and 131.

According to the condenser 100 for the vehicle, the coolant cooled at the radiator 107, as shown in FIG. 5 and FIG. 6, flows firstly into the second heat-radiating portion 120 through the coolant inlet 145.

After the coolant passes the first and second heat-radiating portions 110 and 120 along the coolant lines 115 formed between the plurality of plates 111, the coolant is exhausted through the coolant outlet 118.

At this time, the refrigerant flows from the compressor 105 to the first heat-radiating portion 110 through the refrigerant inlet 117. The refrigerant flowing into the first heat-radiating portion 110 flows along the refrigerant lines 113 formed between the coolant lines 115.

At this time, the first heat-radiating portion 110 condenses the refrigerant through heat-exchange with the coolant. After that, the condensed refrigerant flows into the receiver-drier portion 130 through the connecting pipe 150.

Gas-liquid separation of the refrigerant is performed during the condensed refrigerant circulates in the receiver-drier portion 130, and moistures in the refrigerant is removed by the desiccant 135.

After that, the refrigerant flows into the second heat-radiating portion 120 through the connecting passage 142 and the third connecting hole 121.

The refrigerant flowing into the second heat-radiating portion 120 and the low temperature coolant flowing firstly into the second heat-radiating portion 120 flow to opposite directions. At this time, the refrigerant exchanges heat with the coolant secondarily. Therefore, the refrigerant are cooled secondarily and is supplied to the expansion valve 101 through the refrigerant outlet 143.

Since the receiver-drier portion 130 is connected to the other side of the first and second heat-radiating portions 210 and 220 through the lower cover 140, additional connection pipes for connecting the receiver-drier portion 130 and the first and second heat-radiating portions 110 and 120 can be removed. In addition, the receiver-drier portion 130 has the same shape as the condenser 100, dead volume can be minimized.

Since the condenser is integrally formed with a receiver-drier portion 130, is formed by stacking a plurality of plate, and is adapted to cool refrigerant by using coolant according to various embodiments of the present invention, the number of components may be reduced, a layout of connection pipes may be simplified, and cost and weight may be lowered.

Since the receiver-drier portion 130 is structurally connected to the first and second heat-radiating portions 110 and 120 through the lower cover 140 and is fluidly connected to the connecting pipe 150 through the connecting passage 142, dead volume in the condenser 110 may be minimized and heat-radiating area may be increased. Therefore, condensing efficiency and cooling efficiency may be improved without increasing a size of the condenser 100 and marketability may be improved.

Since the coolant flows into the second heat-radiating portion 120 firstly and the refrigerant passing through the receiver-drier portion 130 is cooled secondarily, temperature of the refrigerant may be further lowered and cooling performance of the air conditioning may be improved.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A condenser for a vehicle which is used in an air conditioner including an expansion valve, an evaporator, and a compressor, wherein the condenser is provided between the compressor and the expansion valve, and circulates coolant supplied from a radiator to condense refrigerant supplied from the compressor through heat-exchange with the coolant and the refrigerant, the condenser comprising:

a first heat-radiating portion formed with a stacked plurality of plates, connected to the radiator to circulate the coolant, and adapted to circulate the refrigerant supplied from the compressor to condense the refrigerant through heat-exchange with the coolant and the refrigerant;

a second heat-radiating portion integrally formed at a lower portion of the first heat-radiating portion and fluid-connecting the radiator and the first heat radiating portion to circulate the coolant;

a receiver-drier portion formed with a stacked plurality of plates, disposed apart from and in parallel with the first and second heat-radiating portions, and connected respectively to the first and second heat-radiating portions to perform gas-liquid separation and moisture removal of the condensed refrigerant supplied from the first heat-radiating portion and to supply the refrigerant to the second heat-radiating portion;

a lower cover simultaneously covering a lower portion of the second heat-radiating portion and a lower portion of the receiver-drier portion and having a connecting passage formed therein, the connecting passage being adapted to flow the refrigerant from the receiver-drier portion into the second heat-radiating portion, wherein the receiver-drier portion is provided with a space formed therein and a desiccant is inserted in the space, and wherein the connecting passage is formed in the lower cover between the second heat-radiating portion and the receiver-drier portion, an end of the connecting passage is connected to a first connecting hole formed at a lower portion of an end portion of the second heat-radiating portion, and another end of the connecting passage is connected to the receiver-drier portion, and a fixing plate mounted at the lower cover, wherein the connecting passage is formed between the fixing plate and the lower cover to fluid-communicate the space with the first connecting hole and wherein the fixing plate prevents leakage of the refrigerant to an exterior of the receiver-drier portion and prevents the desiccant inserted in the space from escaping.

2. The condenser of claim 1, further comprising a connecting pipe connecting the receiver-drier portion with the first heat-radiating portion.

3. The condenser of claim 2, wherein the first heat-radiating portion comprises:

a refrigerant inlet formed at an end portion of the first heat-radiating portion and connected to the compressor to flow the refrigerant into the first heat-radiating portion; and a second connecting hole formed at another end portion of the first heat-radiating portion, an end of the connecting pipe being inserted in the second connecting hole.

4. The condenser of claim 3, wherein the receiver-drier portion is provided with a third connecting hole corresponding to the second connecting hole, and another end of the connecting pipe is inserted in the third connecting hole such that the refrigerant flows from the first heat-radiating portion into the third connecting hole through the connecting pipe.

5. The condenser of claim 3, wherein the first heat-radiating portion is adapted to condense the refrigerant by exchanging heat with the coolant and to exhaust the condensed refrigerant to the receiver-drier portion through the connecting pipe connected to the second connecting hole.

6. The condenser of claim 3, wherein the lower cover comprises:

a refrigerant outlet formed at an end portion of the lower cover corresponding to an coolant inlet and connecting the second heat-radiating portion with the expansion valve; and the coolant inlet formed at an end portion of the lower cover apart from a coolant outlet and connecting the first and second heat-radiating portions with the radiator.

7. The condenser of claim 6, wherein the first heat-radiating portion further comprises the coolant outlet formed at another end thereof apart from the second connecting hole and connected to the radiator to exhaust the coolant to the radiator.

8. The condenser of claim 1, wherein the second heat-radiating portion is adapted to cause the refrigerant which is exhausted from the first heat-radiating portion and in which gas-liquid separation and moisture removal are performed at the receiver-drier portion to secondarily exchange heat with the low temperature coolant.

9. The condenser of claim 1, wherein the second heat-radiating portion causes the coolant and the refrigerant to exchange heat with each other by means of counterflow of the coolant and the refrigerant.

10. The condenser of claim 1, wherein the radiator is connected to a reserve tank and a cooling fan is provided at a rear portion of the radiator.

11. The condenser of claim 1, wherein the condenser comprises a heat exchanger of plate type formed by stacking a plurality of plates.

12. The condenser of claim 1, wherein the lower cover further comprises a fixing protrusion formed along a width direction between the first and second heat-radiating portions and the receiver-drier portion, and the fixing protrusion is adapted to fix the first and second heat-radiating portions and the receiver-drier portion in a state that the first and second heat-radiating portions and the receiver-drier portion are disposed apart from each other.

* * * * *